US008960677B2

(12) United States Patent
Mickelson et al.

(10) Patent No.: US 8,960,677 B2
(45) Date of Patent: Feb. 24, 2015

(54) ADJUSTABLE TARGET STAND AND METHOD OF USE

(71) Applicant: Decoy Revolution, Inc., Prairie du Sac, WI (US)

(72) Inventors: Jeremy J. Mickelson, New Ulm, MN (US); Daniel W. McCarthy, Prairie du Sac, WI (US)

(73) Assignee: Decoy Revolution, Inc., Prairie du Sac, WI (US)

( * ) Notice: Subject to any disclaimer, the term of this patent is extended or adjusted under 35 U.S.C. 154(b) by 136 days.

(21) Appl. No.: 13/797,558

(22) Filed: Mar. 12, 2013

(65) Prior Publication Data

US 2013/0234395 A1 Sep. 12, 2013

Related U.S. Application Data

(60) Provisional application No. 61/609,564, filed on Mar. 12, 2012.

(51) Int. Cl.
*F41J 1/10* (2006.01)

(52) U.S. Cl.
CPC ..... *F41J 1/10* (2013.01)
USPC ..... 273/407; 269/69; 273/390

(58) Field of Classification Search
USPC ..... 273/390–392, 398–410, 378, 386, 387; 269/69, 70
See application file for complete search history.

(56) References Cited

U.S. PATENT DOCUMENTS

| | | | | | |
|---|---|---|---|---|---|
| 1,283,588 | A * | 11/1918 | Staley | 269/50 |
| 2,329,860 | A * | 9/1943 | Staley | 269/50 |
| 2,689,739 | A * | 9/1954 | May | 279/5 |
| 2,881,667 | A * | 4/1959 | Ebert | 269/69 |
| 3,087,701 | A * | 4/1963 | Wallace | 248/166 |
| 3,099,439 | A * | 7/1963 | Haselton | 269/40 |
| 3,641,946 | A * | 2/1972 | Charnay | 108/6 |
| 4,943,040 | A * | 7/1990 | Finstad et al. | 269/69 |
| 5,584,480 | A * | 12/1996 | Grimsrud | 473/416 |
| 5,598,996 | A * | 2/1997 | Rath | 248/163.1 |
| 5,676,378 | A * | 10/1997 | West | 273/390 |
| 5,906,552 | A * | 5/1999 | Padilla | 473/421 |
| 5,979,899 | A | 11/1999 | Wilson | |
| 6,379,272 | B1 * | 4/2002 | Gorgo et al. | 473/421 |
| 6,678,933 | B2 * | 1/2004 | Arvin | 29/281.5 |
| 6,880,828 | B2 * | 4/2005 | Liao | 273/395 |
| D634,956 | S | 3/2011 | St. John | |
| 8,074,994 | B1 | 12/2011 | Delphia | |
| 8,286,968 | B2 * | 10/2012 | Duerr | 273/407 |
| 8,608,170 | B2 * | 12/2013 | Ball | 273/407 |
| 2009/0014961 | A1 * | 1/2009 | Bateman et al. | 273/407 |
| 2011/0074112 | A1 | 3/2011 | Allen | |
| 2011/0175294 | A1 * | 7/2011 | Amodt | 273/407 |

* cited by examiner

*Primary Examiner* — Mark Graham
(74) *Attorney, Agent, or Firm* — Boardman & Clark LLP

(57) ABSTRACT

An adjustable target stand is provided. The adjustable target stand includes a support assembly having a cross member pivotably received by opposing first and second side plates, and at least one target support member carried by and projecting from the cross member. The adjustable target stand also includes a target orientation assembly including a handle coupled to the pivotable cross member, the handle having a handle aperture, and a plurality of apertures provided through the first side plate and radially extending a first distance from a first cross member receiving aperture provided in the first side plate, the plurality of apertures are each in alignment with the handle aperture such that the handle is pivotable between the plurality of apertures such that an angle retention member may engage the handle aperture with one of the plurality of apertures. A method of using an adjustable target stand is also provided.

20 Claims, 12 Drawing Sheets

| Hole | = | Angle |
|---|---|---|
| H | = | 90.0 |
| 1 | = | 84.5 |
| 2 | = | 80.5 |
| 3 | = | 76.5 |
| 4 | = | 72.5 |
| 5 | = | 68.5 |
| 6 | = | 64.5 |
| 7 | = | 60.5 |
| 8 | = | 56.5 |
| 9 | = | 52.5 |
| 10 | = | 48.5 |
| 11 | = | 44.5 |
| 12 | = | 38.5 |
| 13 | = | 32.5 |
| 14 | = | 28.5 |
| 15 | = | 12.5 |
| 16 | = | 7.5 |

ADJUSTABLE TARGET STAND AND METHOD OF USE

CROSS REFERENCE TO RELATED APPLICATIONS

This application claims priority to U.S. Provisional Application No. 61/609,564, filed Mar. 12, 2012, entitled TARGET STAND AND METHOD OF USE, the contents of which is hereby incorporated by reference in its entirety.

FIELD OF THE INVENTION

The present invention relates to stands for the support of a target. More specifically, the present invention relates to a target support and associated stand which enables a user to simulate a target orientation based upon a desired distance and/or elevation from the target.

BACKGROUND

Targets are generally known in the art. A target is an instrument which is used as an aiming point and which is subsequently penetrated by a projectile released during a shooting activity. A shooting activity may include the discharge of a firearm, the release of an arrow by a bow, or the triggering of any device which releases a projectile in a specified direction.

Generally, during a shooting activity, a user (or shooter) will aim the bow, firearm, or other device toward the target. The target is generally a two dimensional object, for example concentric circles having decreasing diameters leading to a "bulls eye" center circle, or a three dimensional object simulating a live specimen in which a user would shoot, for example a deer, bear, human, or other animal. With two dimensional or three dimensional targets, the target typically has a desired aiming area, such as a bulls eye, kill zone, or outlined kill area. In addition, the target is typically oriented perpendicular to the ground on which it is positioned upon. In addition, the largest surface area of the target, or side of the target, is typically oriented to face the user (or shooter).

The above described shooter-to-target orientation has certain advantages. For example, a shooter may desire to improve accuracy while practicing the shooting activity. Having the largest surface area of the target face the shooter allows the shooter to receive feedback regarding the accuracy or inaccuracy of a shot. This is especially desired when the projectile is reusable, as with an arrow. By increasing the surface area of the target facing the shooter, the shooter has a greater chance of hitting the target with a shot which is errant or which does not hit the desired aiming area (i.e. bulls eye, kill zone, or outlined kill area). This increases the likelihood of the shooter having the errant shot be retained in the target, rather than being released beyond the target. Should the reusable projectile be released beyond the target, the shooter may have to search for the reusable projectile and/or may lose the reusable projectile.

However, the above described shooter-to-target orientation has certain disadvantages. For example, a shooter is limited in his or her ability to simulate shooting at a target while simulating certain actual conditions, such as shooting from an elevation.

For example, while hunting, a hunter will often take a position outside of the field of view of an animal which is being hunted. As such, the hunter may take a position above the animal, such as in a tree, tree stand, or other elevated structure. Similarly, the hunter may take a position below the animal, such as in a valley or low ground. Whether positioned above or below the animal, the hunter is provided at an elevation to the animal. When the hunter is provided at an elevation to the animal, the hunter generally does not view the animal from the side or broadside. Accordingly, in order to simulate shooting at an elevation, such as for practice, a shooter must position the target and then physically move to an elevation to the target, for example to a tree stand, platform, roof, valley, or other structure or position provided at an elevation to the target.

Unfortunately, physically moving to an elevation to the target to simulate shooting at an elevation has several disadvantages. For example, physically moving to an elevation can lead to a loss in shooting time. In addition, physically moving to an elevation can lead to a loss in physical energy of the shooter. For example, if the shooter is shooting a bow and arrow, the shooter often carries or has a limited number of arrows. Once the shooter releases or shoots all of the arrows from an elevation toward the target, the shooter must leave the elevation, collect the arrows, and then return to the elevation to shoot at the target again. The shooter unnecessarily spends time which could be used for shooting by leaving the elevated position and subsequently returning to the elevated position. In addition, the shooter expends physical energy leaving the elevated position and subsequently returning to the elevated position. This can result in a loss of shooting time due to fatigue.

In addition, the shooter may not be able to physically move to an elevation to a target. For example, the terrain available to the shooter may be generally flat without trees, valleys, or other structures. As such, there may be no elevation or elevation location available for the shooter to physically move to. This results in the shooter being unable to simulate or practice shooting at a target from an elevation.

SUMMARY OF THE DESCRIPTION

The present invention provides an adjustable target support and associated stand which enables a user to simulate a target orientation based upon a desired distance and/or elevation from the target. In addition, the stand provides for a target to be selectively oriented based upon the distance a shooter is from the target and/or the angle of elevation a shooter is to the target. In addition, the adjustable target support and associated stand allows a shooter to position a target perpendicular to the ground on which the stand is positioned upon such that the side of the target is oriented to face the shooter.

An adjustable target stand is provided. The adjustable target stand includes a support assembly having a cross member pivotably received by opposing first and second side plates, and at least one target support member carried by and projecting from the cross member. The adjustable target stand also includes a target orientation assembly including a handle coupled to the pivotable cross member, the handle having a handle aperture, and a plurality of apertures provided through the first side plate and radially extending a first distance from a first cross member receiving aperture provided in the first side plate, the plurality of apertures are each in alignment with the handle aperture such that the handle is pivotable between the plurality of apertures such that an angle retention member may engage the handle aperture with one of the plurality of apertures.

A pivotable target stand is also provided. The pivotable target stand includes a cross member having a first end and a second end, the first end pivotably received by a first receiving aperture provided in a first side plate, the second end pivotably received by a second receiving aperture provided in a second side plate, and a target support member carried by and projecting from the cross member. A handle is coupled to the cross member and adapted to pivot the cross member about an axis formed between the first and second receiving apertures of the first and second side plates, the handle having a handle aperture which corresponds to a plurality of apertures provided in the first side plate, the plurality of apertures radially provided along the first side plate, the handle aperture provided in alignment with the plurality of apertures such that an angle retention member is received by the handle aperture and one of the selected plurality of apertures provided in the first side plate.

DETAILED DESCRIPTION

The invention illustrated in the Figures and disclosed herein is generally directed to a target stand and associated method for the operation of the target stand. For ease of discussion and understanding, the following detailed description will at times refer to a "target." While certain illustrations may include a certain type of target, such as a three dimensional animal target, it should be appreciated that a "target" may include, but it not limited to, a two dimensional target, three dimensional target, simulated animal target, a simulated human target, and/or any suitable object in which a user may desire to shoot at with a projectile. For example, a "target" may include any simulated animal which a shooter may desire to shoot at, including, but not limited to, a deer, bear, elk, moose, antelope, sheep, human being, or other animal. It should also be appreciated that a "projectile" may include a bullet, arrow, rock, or any other known or future developed item which may be shot by a user or shooter.

Referring now to the figures, one or more examples of embodiments of an adjustable target stand 100, 200 is provided. Adjustable target stand 100, 200 may include a support assembly 150 and a target orientation assembly 170.

Figure 1:
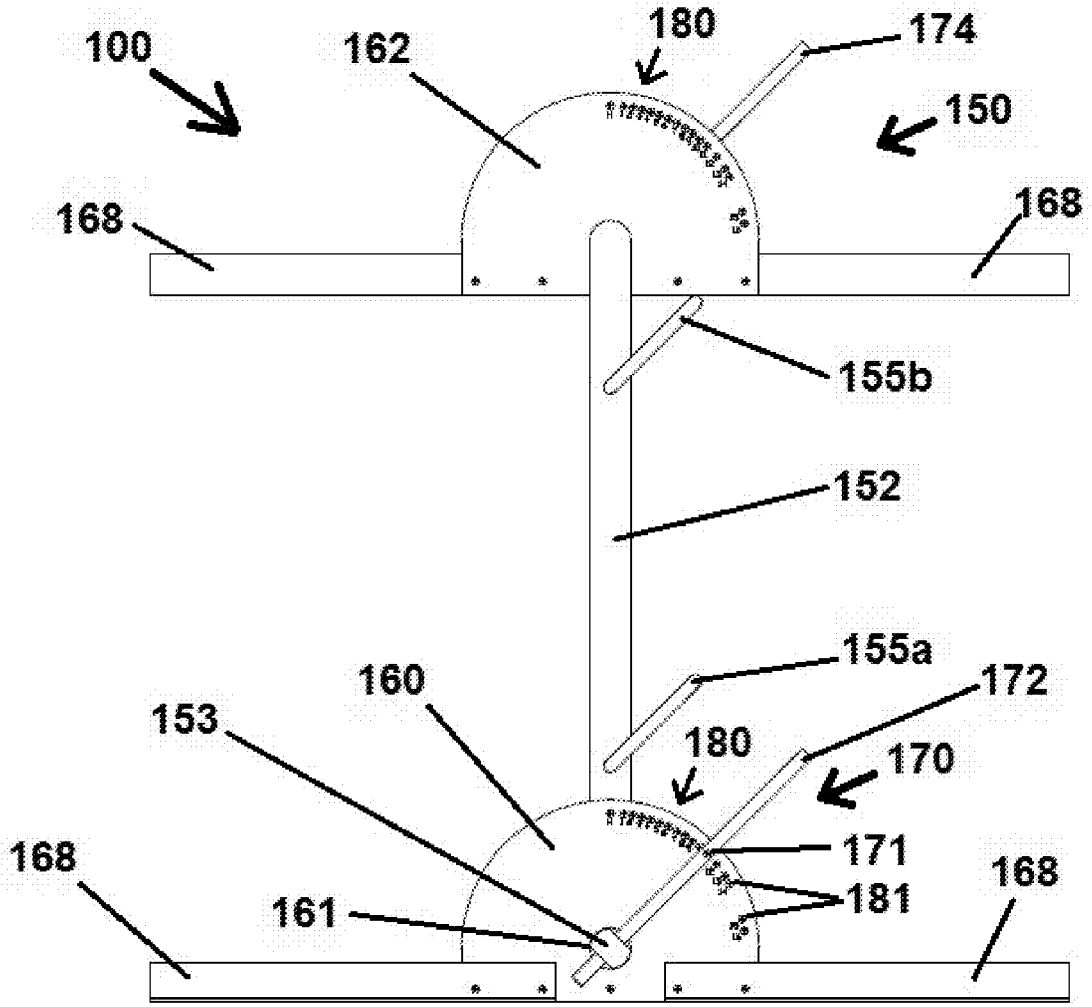
FIG. 1 is an elevated side view of one or more examples of embodiments of an adjustable target stand.

FIG. 1 illustrates adjustable target stand 100. Adjustable target stand 100 may include support assembly 150. Support assembly 150 may include a cross member or shaft 152. Cross member 152 may include a first end 153 and a second end 154 (see FIGS. 2 and 3). Cross member 152 may be coupled to a first side plate 160 at the first end 153. In addition, cross member 152 may be coupled to a second side plate 162 at the second end 154. As shown in FIG. 1, first end 153 of cross member 152 may be received by a first cross member receiving aperture 161 provided in the first side plate 160. In addition, second end 154 of cross member 152 may be received by a second cross member receiving aperture 163 provided in second side plate 162 (see FIG. 6).

Adjustable target stand 100 and the associated support assembly 150 may include one or more support legs 168. As illustrated in FIG. 1, a plurality of support legs 168 may be coupled to side plates 160, 162. More specifically, two support legs 168 may be coupled to first side plate 160, and two support legs 168 may be coupled to second side plate 162. As illustrated in FIG. 1, support legs 168 may be bolted to each respective side plate 160, 162 at a plurality of bolt positions. In one or more examples of embodiments, the support legs may be coupled, attached, or otherwise connected to the side plates by weld, bolt, screw or other suitable known or future developed attachment device. In one or more examples of embodiments, a single support leg may be coupled to the first side plate, and a single support leg may be coupled to the second side plate. Further, in one or more examples of embodiments, the target stand may not include any support legs. In one or more examples of embodiments of the target stand having support legs, the support legs may be any suitable length, cross sectional shape, material, and/or size suitable to provide structural support for the target stand, structural support for the associated target attached to the stand, and/or to assist in maintaining the position of the target stand such that the target stand remains in physical contact with the ground or terrain in which the target stand is placed.

Cross member 152 may include a target support member 155. As illustrated in FIG. 1, cross member 152 may carry a first target support member **155*a* and a second target support member 155*b*. Target support member 155*a*, 155*b* may be attached to or coupled to cross member 152. In addition, target support member 155*a*, 155*b* may be repositionable and/or removable from cross member 152. For example, each target support member 155*a*, 155*b* may be attachable to cross member 152 by a bolt and/or wing nut, enabling target support member 155*a*, 155*b* to selectively engage cross member 152 while being selectively removable from cross member 152**.

Adjustable target stand 100 may also include target orientation assembly or target positioning assembly or target orientation retention assembly or target position retention assembly 170. Target orientation assembly 170 may include one or more target positioning handles 172, 174. As shown in FIG. 1, two target positioning handles 172, 174 are illustrated. First target positioning handle 172 may be attached to or coupled to or received by first end 153 of cross member 152. Similarly, second target positioning handle 174 may be attached to or coupled to or received by second end 154 of cross member 152. In addition, first and second target positioning handles 172, 174 may be parallel to target support members 155*a*, 155*b* provided on cross member 152. For example, first handle 172 may be provided parallel to first target support member 155*a*. Further, second handle 174 may be provided parallel to second target support member 155*b*. Further, first and second target positioning handles 172, 174 may be parallel to one another. In addition, first and second target supports 155*a*, 155*b* may be provided parallel to one another.

Cross member 152 may be pivotably received or rotatably received by respective first and second cross member receiving apertures 161, 163. As such, cross member 152 may be rotatable about or pivotable about support assembly 150. In addition, cross member 152 may be rotatable about or pivotable about first and second side plates 160, 162. First and second target positioning handles 172, 174 may assist a user or shooter in pivoting or rotating cross member 152 about first and second side plates 160, 162. Stated otherwise, first handle 172, second handle 174, and cross member 152 may be adapted to rotate within cross member receiving apertures 161, 163, enabling rotation of cross member 152 independent of the first and second side plates 160, 162.

Target orientation assembly 170 may include a target angle assembly or orientation selector assembly 180. Target angle assembly 180 may be carried by one or both of first and second side plates 160, 162. Target angle assembly 180 may include a plurality of apertures 181 provided in a side plate 160, 162. In addition, target angle assembly 180 may include one or more handle apertures 171 provided in handle 172. Similarly, one or more handle apertures 171 may be provided in handle 174 (not shown). In addition, an angle retention member or pin or detent pin 182 may be removably received by one of the handle apertures 171, and a desired or selected one of the plurality of apertures 181. In one or more examples of embodiments, a first pin 182*a* may be removably received by handle aperture 171, and a desired or selected one of the plurality of apertures 181 provided in first side plate 160. In addition, in one or more examples of embodiments, a second pin 182*b* may be removably received by handle aperture 171, and a desired or selected one of the plurality of apertures 181 provided in second side plate 162. Thus, handle apertures 171 are preferably in alignment with the plurality of aperture 181 in order to removably receive and retain pin 182. This provides for a user to select and maintain a desired target orientation as handle 172 and/or 174 and associated cross member 152 is rotated about side plates 160, 162. In one or more examples of embodiments, first and second side plates 160, 162 may each carry a target orientation selector assembly 180.

Figure 2:
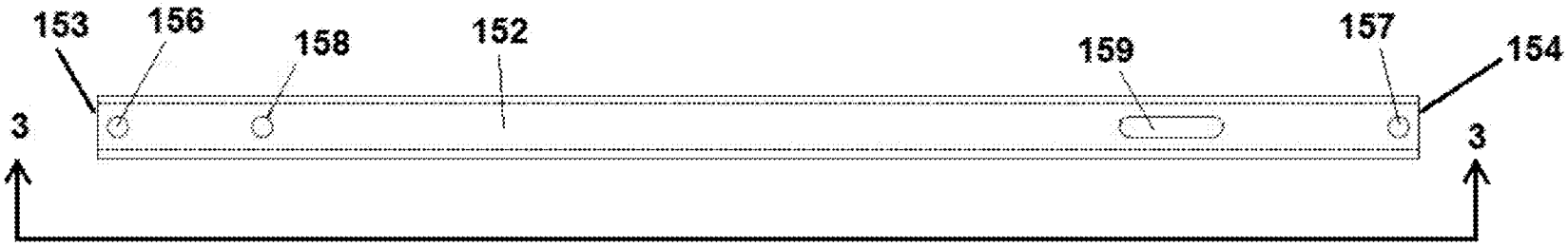
FIG. 2 is a top down view of one or more examples of embodiments of the cross member of FIG. 1.
Figure 3:
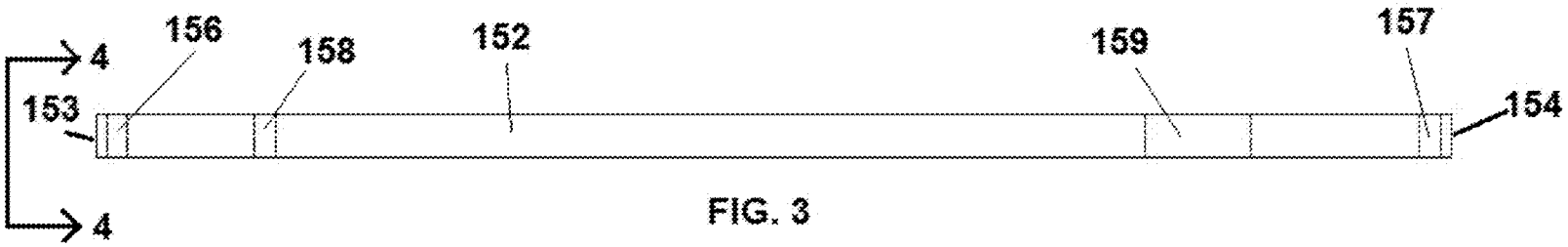
FIG. 3 is a side view of one or more examples of embodiments of the cross member of FIG. 1, taken along line 3-3 of FIG. 2.

FIGS. 2 and 3 provide additional illustrations of cross member 152. Cross member 152 may include first and second ends 153, 154. In addition, cross member 152 may include handle apertures 156, 157 for respectively receiving first handle 172 and/or second handle 174. More specifically, first handle 172 may be received by a first handle aperture 156 to engage cross member 152. Second handle 174 may be received by a second handle aperture 157 to engage cross member 152. As illustrated, handle apertures 156, 157 may pass entirely through cross member 152. However, in one or more examples of embodiments, one or more of the handle apertures may extend through a portion of the cross member without passing entirely through the cross member. In one or more examples of embodiments, the first and second handles may be coupled, attached, or otherwise connected to the cross member by weld, screw, or other suitable known or future developed attachment device.

Cross member 152 may also include a first target support receiving aperture 158 and a second target support receiving aperture 159. A first target support member 155*a* may be coupled to and/or received by first target support receiving aperture 158, allowing first target support member 155*a* to engage cross member 152. A second target support member 155*b* may be coupled to and/or received by second target support receiving aperture 159, allowing second target support member 155*b* to engage cross member 152. Second target support receiving aperture 159 is illustrated as a selective target support receiving aperture 159. Selective target support receiving aperture 159 is illustrated as an oblong aperture having parallel sides which extend a first distance. This provides for the selective positioning of the second target support member 155*b* in relation to the first target support member 155*a*. Stated otherwise, this provides for the second target support member 155*b* to be positioned at different distances from the first target support member 155*a*. The different distances between the first and second target supports 155*a*, 155*b* may be necessary to support different sizes, types, or brands of targets. As illustrated, target support members 155*a*, 155*b* may pass entirely through cross member 152. However, in one or more examples of embodiments, one or more of the target support receiving apertures may extend through a portion of the cross member without passing entirely through the cross member. In addition, in one or more examples of embodiments, the first and second target support receiving apertures may be both selective target support receiving apertures. In addition, first and second target support member may be coupled, attached, or otherwise connected to the cross member by bolt, weld, screw, or other suitable known or future developed attachment device. In one or more examples of embodiments, target support members 155*a*, 155*b* may be received by, coupled to, connected to, or attached to a target using any suitable known or future developed connection device.

Figure 4:
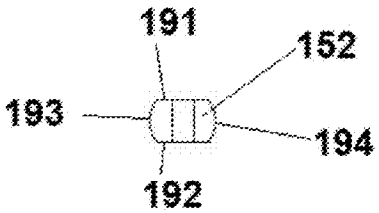
FIG. 4 is an end view of one or more examples of embodiments of the cross member of FIG. 1, taken along line 4-4 of FIG. 3.

Referring to FIG. 4, cross member 152 may have a cross section defined by a first portion 191 and a second portion 192. First and second portions 191, 192 may be planar portions provided parallel to each other. First and second portions 191, 192 may be connected by opposing arcuate portions 193, 194. As such, the cross section of cross member 152 may have a variable radius such that the radius in a first direction from a center position to an arcuate portion 193, 194 extends a first distance, and the radius in a second direction perpendicular to the first direction, and which extends a second distance from the center position to a planar portion 191, 192, is less than the first distance.

Figure 6:
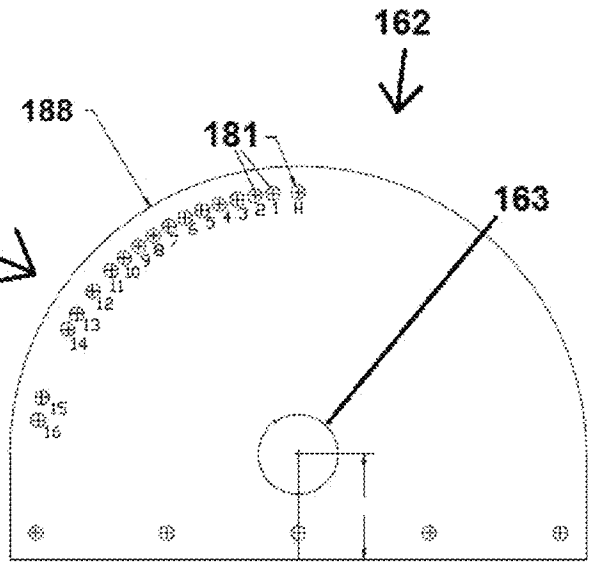
FIG. 6 is an elevation view of the second side plate of one or more examples of embodiments of the cross member of FIG. 1, illustrating the apertures associated with the target position retention assembly.
Figure 5:
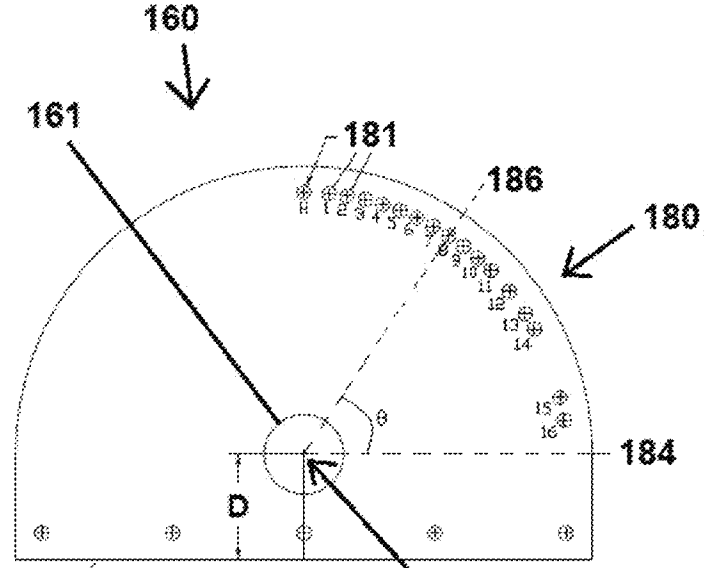
FIG. 5 is an elevation view of the first side plate of one or more examples of embodiments of the cross member of FIG. 1, illustrating the apertures associated with the target position retention assembly.

Referring to FIGS. 5 and 6, first and second side plates 160, 162 may have an arcuate perimeter 188. In addition, first and second side plates 160, 162 may respectively include first and second cross member receiving apertures 161, 163. One or both of first and second side plates 160, 162 may include target angle assembly 180. Target angle assembly 180 may include a plurality of apertures 181 provided in one or both of side plates 160, 162. Apertures 181 are each provided at an angle θ (theta), defined as an angle between a hypothetical first line 184 which intersects a center 187 of the cross member receiving aperture 161, 163 and which is generally parallel to a bottom 185 of each side plate 160, 162, and a hypothetical radian 186 from center 187 of each cross member receiving aperture 160, 162 to a center of each of the apertures 181. The angles θ may range from zero degrees to one hundred eight degrees. In addition, center 187 may be provided a distance D from the bottom 185 of each side plate 160, 162. Apertures 181 may be provided at various intervals along an arcuate line equidistant from center 187 of each cross member receiving aperture 161, 163. This provides angles θ (theta) ranging from seven and one half degrees to ninety degrees. In one or more examples of embodiments, any suitable and/or desired number of apertures may be provided at any suitable and/or desired angles θ (theta).

In order to provide for ease of use of target stand 100, apertures 181 provided through one or more plates 160, 162 may be provided at a pre-developed set of preferred angles θ (theta). This provides a user or shooter the option to simulate a target orientation based upon a distance from the target and/or an elevation from the target. For example, the angles have been developed as a tabular format 120, shown below:

| | | Elevation Height (Ft.) | | | | | | | | | | |
|---|---|---|---|---|---|---|---|---|---|---|---|---|
| | | 12 | 14 | 16 | 18 | 20 | 22 | 24 | 26 | 28 | 30 | |
| Target Distance (Ft.) | 3 | 14 | 12 | 11 | 9 | 9 | 8 | 7 | 7 | 6 | 6 | Target Angle |
| | 15 | 51 | 47 | 43 | 40 | 37 | 34 | 32 | 30 | 28 | 27 | |
| | 30 | 68 | 65 | 62 | 59 | 56 | 54 | 51 | 49 | 47 | 45 | |
| | 45 | 75 | 73 | 70 | 68 | 66 | 64 | 62 | 60 | 58 | 56 | |
| | 60 | 79 | 77 | 75 | 73 | 72 | 70 | 68 | 67 | 65 | 63 | |
| | 75 | 81 | 79 | 78 | 77 | 75 | 74 | 72 | 71 | 70 | 68 | |
| | 90 | 82 | 81 | 80 | 79 | 77 | 76 | 75 | 74 | 73 | 72 | |
| | 105 | 83 | 82 | 81 | 80 | 79 | 78 | 77 | 76 | 75 | 74 | |
| | 120 | 84 | 83 | 82 | 81 | 81 | 80 | 79 | 78 | 77 | 76 | |
| | 135 | 85 | 84 | 83 | 82 | 82 | 81 | 80 | 79 | 78 | 77 | |
| | 150 | 85 | 85 | 84 | 83 | 82 | 82 | 81 | 80 | 79 | 79 | |
| | 165 | 86 | 85 | 84 | 84 | 83 | 82 | 82 | 81 | 80 | 80 | |
| | 180 | 86 | 86 | 85 | 84 | 84 | 83 | 82 | 82 | 81 | 81 | |

Along the X-axis is a range of optional elevation heights from the target (in Feet), and along the Y-axis is a range of distances from the target (in Feet). The angle of the target has been calculated based upon the height in feet the shooter is above the target or elevation height (X-axis), and the distance the target is from the shooter or target distance (Y-axis).

To further assist in the ease of use of the target stand, the above table 120 has been modified to replace various angles with certain numeric identifiers. The modified table is shown below:

| | | Elevation Height (Ft.) | | | | | | | | | | |
|---|---|---|---|---|---|---|---|---|---|---|---|---|
| | | 12 | 14 | 16 | 18 | 20 | 22 | 24 | 26 | 28 | 30 | |
| Target Distance (yards) | 1 | 15 | 15 | 15 | 16 | 16 | 16 | 16 | 16 | 16 | 16 | Target Position (Hole) |
| | 5 | 9 | 10 | 11 | 12 | 12 | 13 | 13 | 14 | 14 | 14 | |
| | 10 | 5 | 6 | 7 | 7 | 8 | 9 | 9 | 10 | 10 | 11 | |
| | 15 | 3 | 4 | 5 | 5 | 6 | 6 | 7 | 7 | 8 | 8 | |
| | 20 | 2 | 3 | 3 | 4 | 4 | 5 | 5 | 5 | 6 | 6 | |
| | 25 | 2 | 2 | 3 | 3 | 3 | 4 | 4 | 4 | 5 | 5 | |
| | 30 | 2 | 2 | 2 | 2 | 3 | 3 | 3 | 4 | 4 | 4 | |
| | 35 | 1 | 2 | 2 | 2 | 2 | 3 | 3 | 3 | 3 | 4 | |
| | 40 | 1 | 1 | 2 | 2 | 2 | 2 | 2 | 3 | 3 | 3 | |
| | 45 | 1 | 1 | 1 | 2 | 2 | 2 | 2 | 2 | 3 | 3 | |
| | 50 | 1 | 1 | 1 | 1 | 2 | 2 | 2 | 2 | 2 | 2 | |
| | 55 | 1 | 1 | 1 | 1 | 1 | 2 | 2 | 2 | 2 | 2 | |
| | 60 | 1 | 1 | 1 | 1 | 1 | 1 | 2 | 2 | 2 | 2 | |

Each numeric identifier corresponds to one of the apertures 181 provided with the target orientation selector assembly 180 through side plates 160, 162, as illustrated in FIGS. 5 and 6. In addition, each numeric identifier corresponds to a target angle or range of target angles θ (theta). As such, a user determines a desired elevation height of the shooter to the target or height in feet the shooter is above the target or is below the target (X-axis), and the distance the target is from the shooter in yards (Y-axis). Based upon the intersection of the predetermined elevation height and target distance, a numeric identifier or alphanumeric identifier or identifier is determined, where each respective identifier corresponds to an aperture 181 provided in one or both plates 160, 162.

Figure 7:
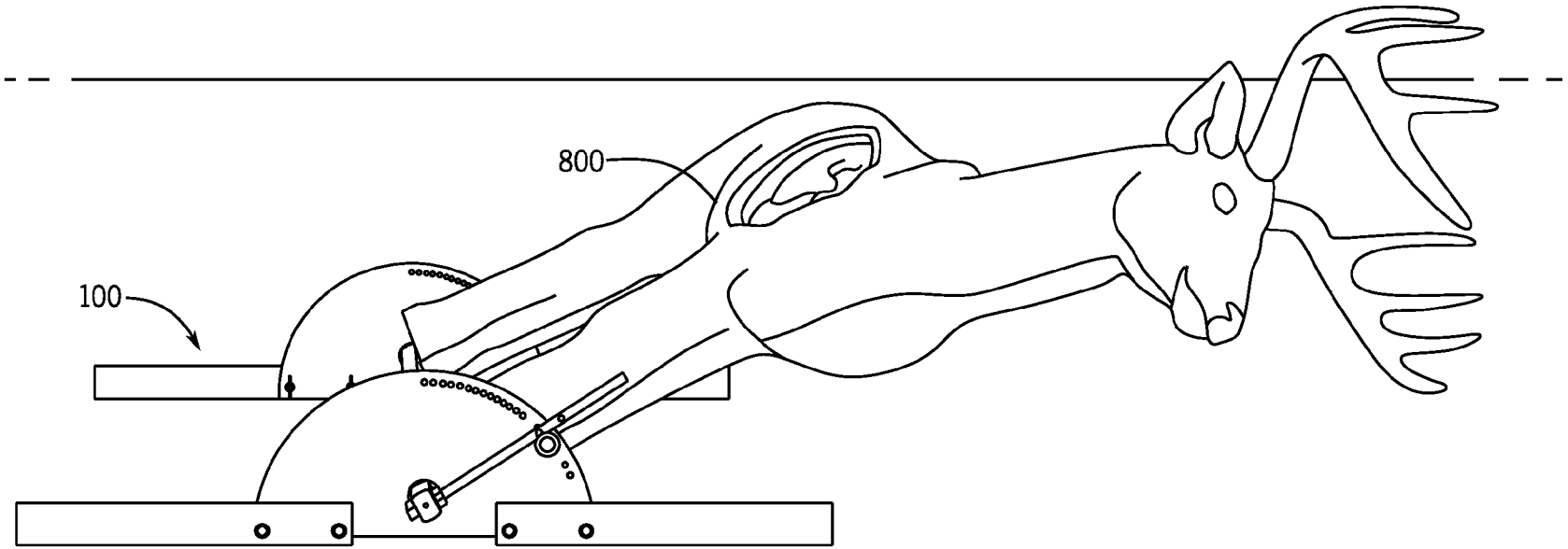
FIG. 7 is a side view of one or more examples of embodiments of the target stand of FIG. 1 illustrating a target coupled to the target stand and provided at a selected stand setting and associated target orientation.
Figure 8:
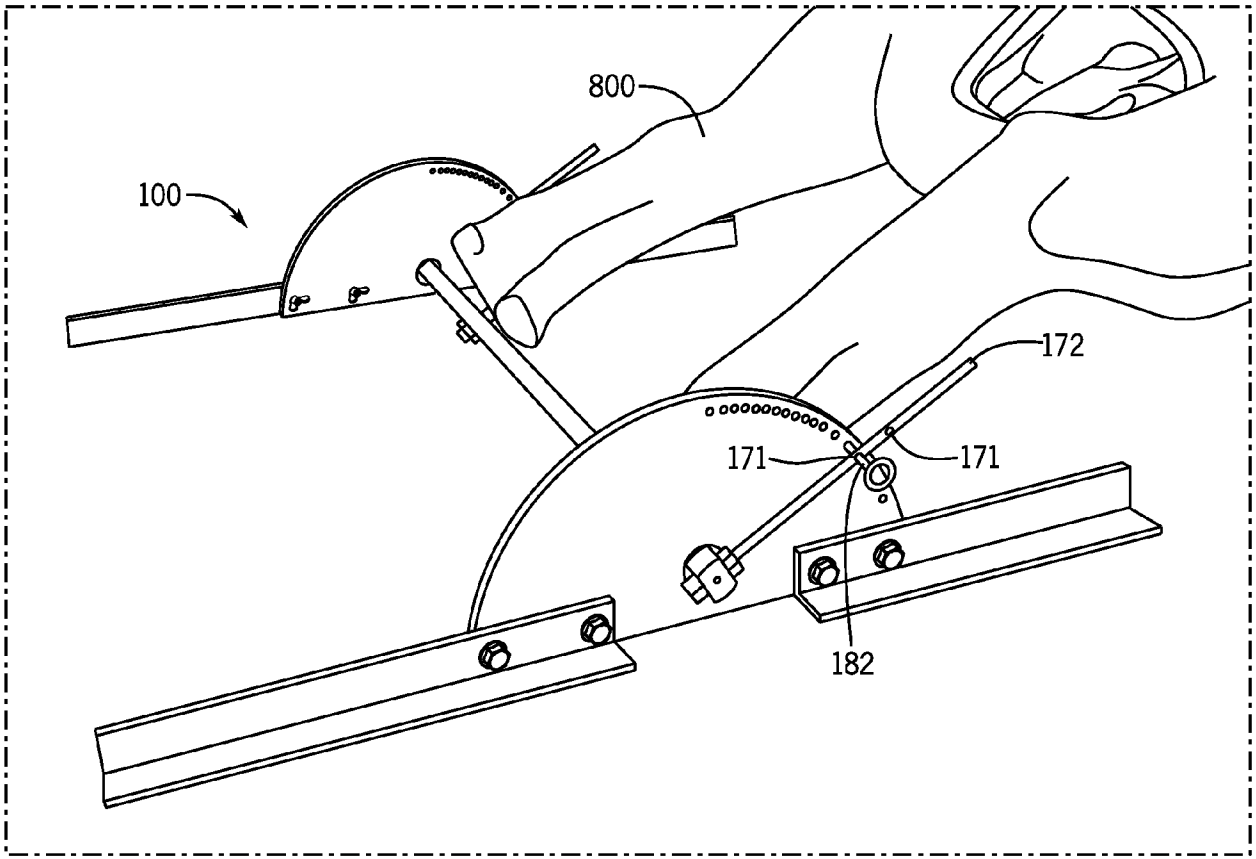
FIG. 8 is an isometric view from a first side of the target stand, illustrating the stand and target coupled thereto, and the stand setting and target orientation shown in FIG. 7.
Figure 9:
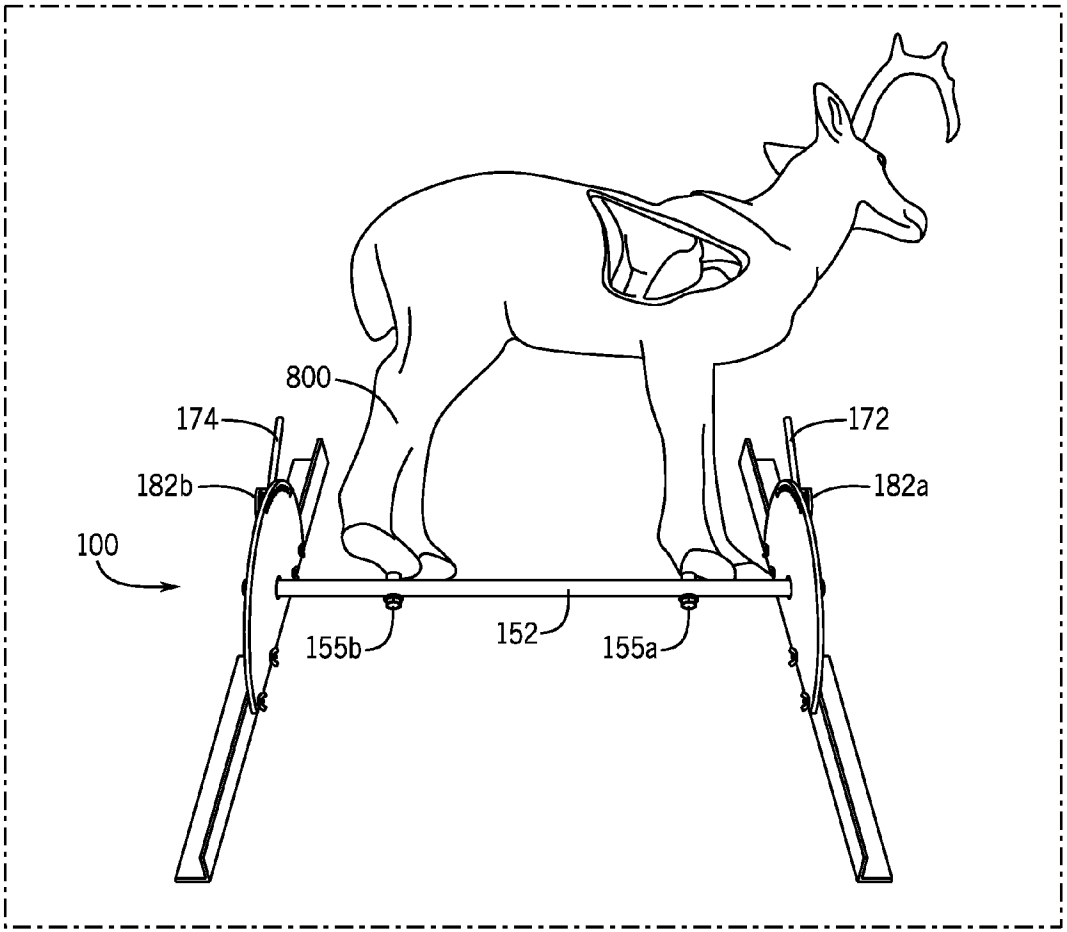
FIG. 9 is an elevated view from behind of the target stand and target coupled thereto, illustrating the stand setting and target orientation shown in FIG. 7.
Figure 10:
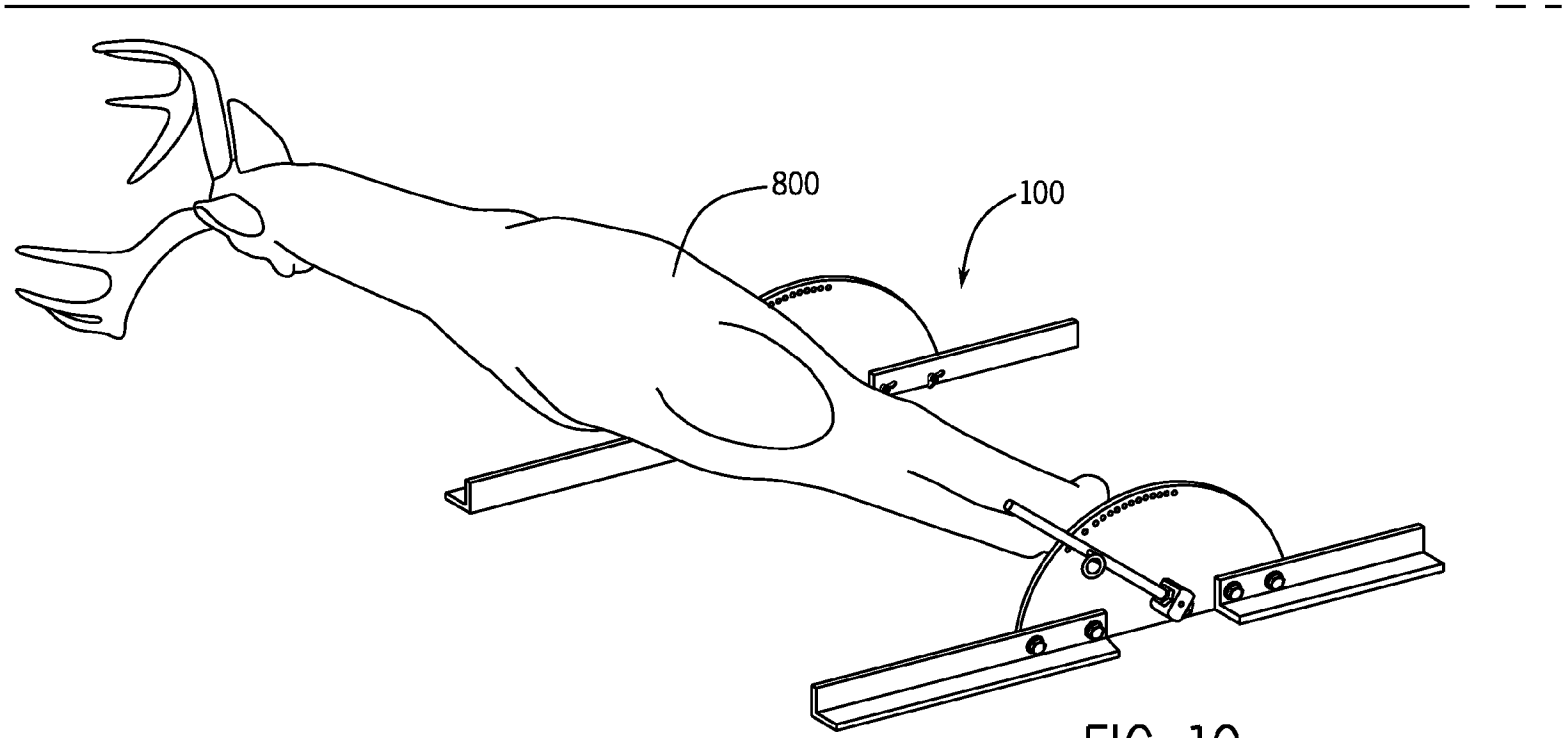
FIG. 10 is an isometric view from a second side of the target stand opposite the first side, illustrating the stand and target coupled thereto, and the stand setting and target orientation shown in FIG. 7.
Figure 11:
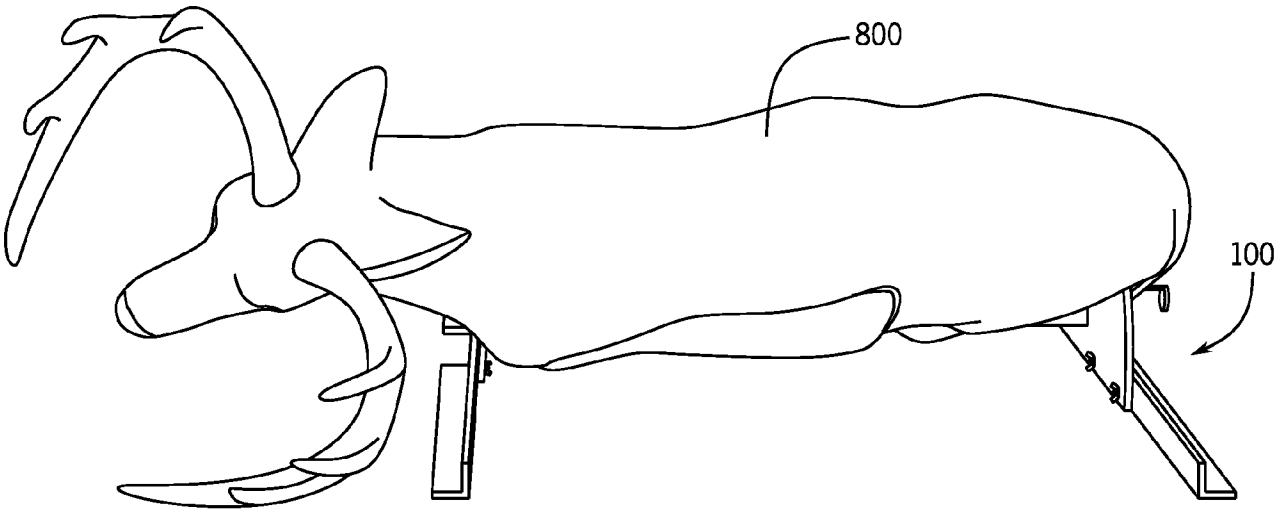
FIG. 11 is a front view or shooters view of the target attached to the target stand, illustrating the stand setting and target orientation shown in FIG. 7.

FIGS. 7-11 illustrate views of one or more examples of embodiments of target stand 100 coupled to a target 800 in which target position retention assembly 170 is arranged to simulate the orientation of target 800 at a predetermined elevation height above (or below) target 800 and a predetermined distance away from target 800. As such, target 800 is arranged at a predetermined angle θ (theta) which corresponds to the desired predetermined elevation height above (or below) the target 800 and predetermined distance away from the target 800. Specifically, FIGS. 7-11 illustrate various views of target 800 provided at target position number thirteen (13) on one or more embodiments of the target stand 100 disclosed herein. Target position number thirteen (13) simulates the orientation of target 800 for a shooter who is at an elevation of twenty-two (22) feet above the target, and at a distance of five (5) yards away from the target. It should be appreciated that the target position number thirteen (13) may be used to simulate the orientation of target 800 for a shooter who is at an elevation of between twenty-two (22) and twenty-four (24) feet above the target, and at a distance of five (5) yards away from the target. FIG. 7 illustrates a side view of one or more examples of embodiments of target stand 100 and target 800 coupled thereto. FIG. 8 illustrates an isometric view of a first side of target stand 100 and target 800 coupled thereto. FIG. 9 illustrates an elevated view from behind of target stand 100 and target 800 coupled thereto. FIG. 9 also illustrates target 800 as coupled to first and second target support members 155*a*, 155*b*. More specifically, first and second target support members 155*a*, 155*b* project from cross member 152 and are received by passages (not shown) provided in target 800. In one or more examples of embodiments, the target may be coupled to the target stand in any manner suitable for operation of the target stand in accordance with the present disclosure. FIG. 10 illustrates an isometric view from a second side of target stand 100 and target 800 coupled thereto, wherein the second side is provided opposite the first side of target stand 100. FIG. 11 illustrates a front view or shooters view of target 800 attached to target stand 100.

In addition, as illustrated in FIG. 8, target stand 100 includes handle apertures 171 provided in handle 172. Handle aperture 171 receives angle retention member or pin 182. In addition, pin 182 is received by one of the desired or selected plurality of apertures 181. In the illustrated example, pin 182 is received by aperture 181 coinciding with target position number thirteen (13) (as shown in FIGS. 5 and 6). As shown in FIG. 9, first handle 172 may removably receive and retain first pin 182*a*, while second handle 174 may removably receive and retain second pin 182*b*.

Figure 12:
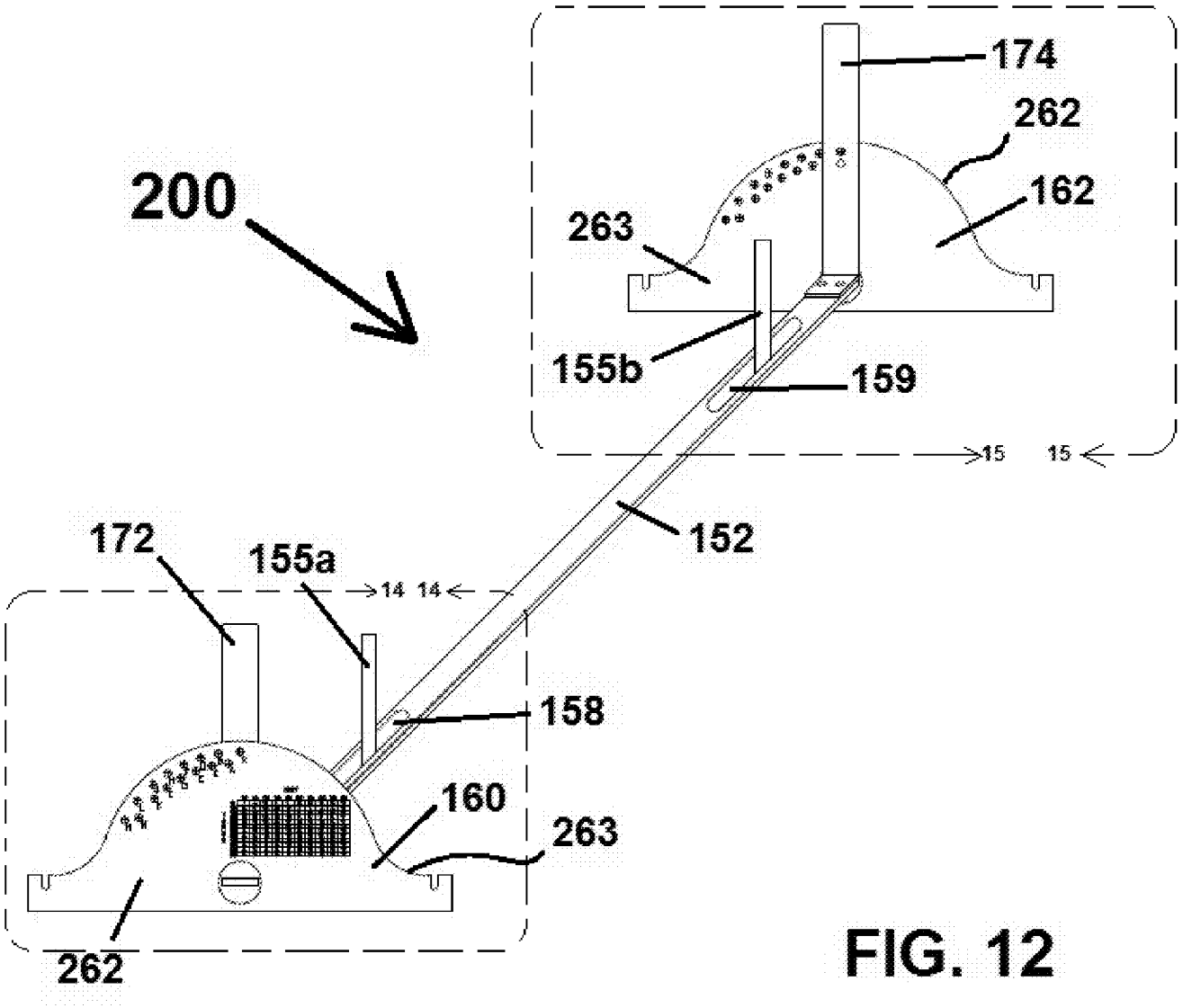
FIG. 12 is an isometric view of one or more alternative examples of embodiments of an adjustable target stand.

An alternative example of embodiments of adjustable target stand 200 is illustrated in FIGS. 12-15. The alternative example of embodiments of adjustable target stand 200 includes features which are substantially as described herein in association with adjustable target stand 100. Operation and particular components described herein are substantially the same and like numbers have been used to illustrate the like components. Referring to FIG. 12, in this embodiment, adjustable target stand 200 may include cross member 152 rotatably coupled and received between first and second side plates 160, 162. Handles 172, 174 may be coupled to cross member 152. However, handles 172, 174 are provided on a cross member side or second side 263 of each side plate 160, 162, rather than an outer side or first side 262 of each side plate 160, 162 (as in stand 100). Cross member 152 includes a first target support receiving aperture 158 and a second target support receiving aperture 159. Both target support receiving apertures 158, 159 are selective target support receiving apertures 158, 159, enabling the target support members 155*a*, 155*b* to selectively engaged and be retained by apertures 158, 159 at several distances along apertures 158, 159 and/or distances between target support members 155*a*, 155*b*. This allows target support members 155*a*, 155*b* to be adjustable to several distances there between in order to accommodate, engage, and/or retain different sized and/or branded targets.

Figure 13:
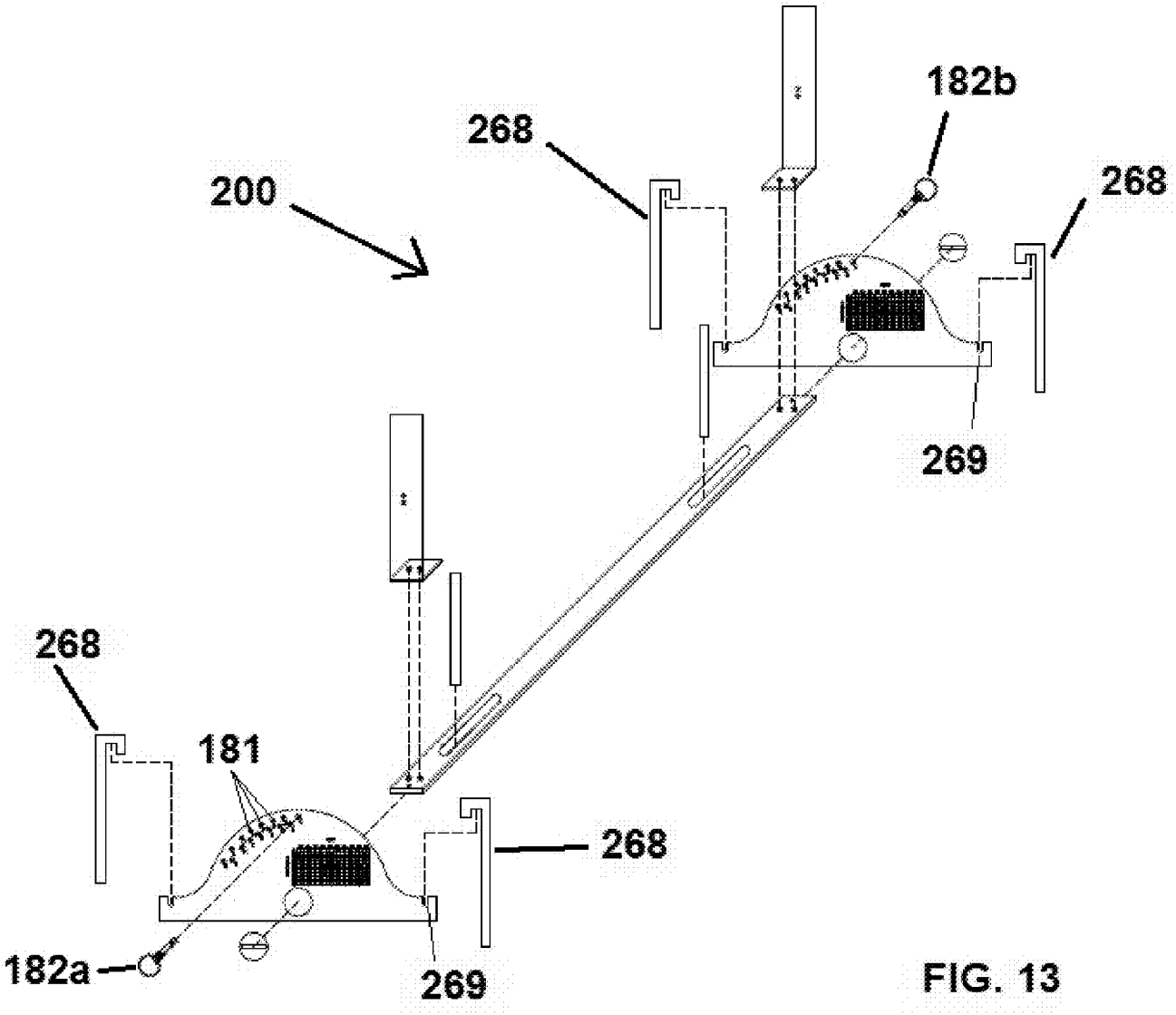
FIG. 13 is an exploded view of the adjustable target stand of FIG. 12.

Referring to FIG. 13, adjustable target stand 200 may include a plurality of support legs 268. Support legs 268 may be received by slots 269 provided in plates 160, 162. In addition, support legs 268 may be adapted to engage or be received by ground in which stand 200 is positioned upon. Stated otherwise, support legs 268 may act like stakes driven into the ground and which also engage portions of plates 160, 162 in order to maintain stand 200 in a desired position or location. Stand 200 may also include pins 182*a*, 182*b* for selectively setting and retaining the desired position and/or angle of an associated target provided on stand 200. Pins 182*a*, 182*b* may be adapted to be received by one of apertures 181 of target angle assembly 180 provided on plates 160, 162.

Figure 14:
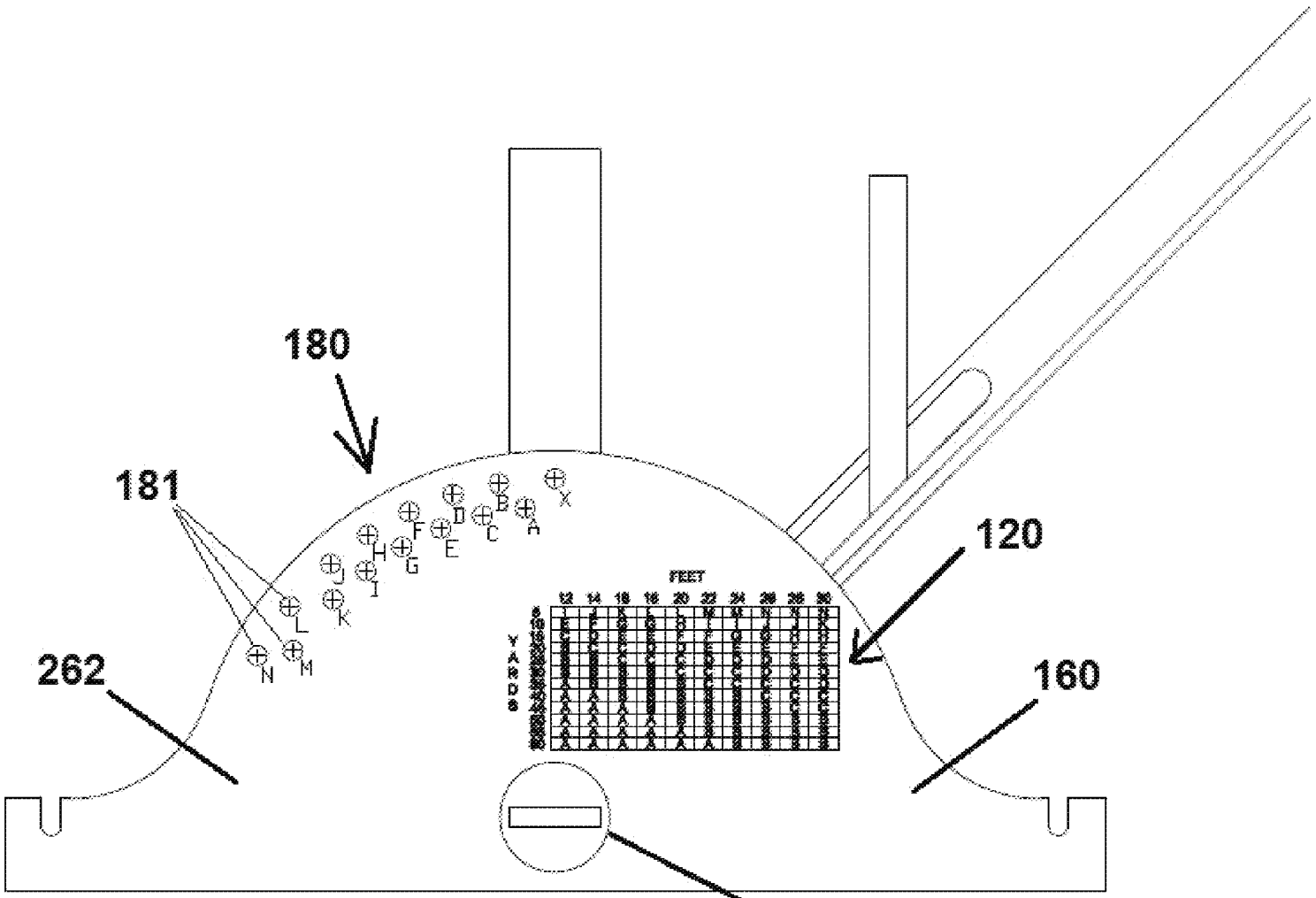
FIG. 14 is a zoomed in view of a portion of the adjustable target stand of FIG. 12, taken along line 14-14 of FIG. 12.

Referring to FIG. 14, apertures 181 of target angle assembly 180 are provided in two separate arcuate rows. The first row includes apertures 181 labeled "X, B, D, F, H, J, L, N." The second row includes apertures 181 labeled "A, C, E, G, I, K, M." Apertures 181 of the first row are provided a first distance from the center of receiving aperture 161, while apertures 181 of the second row are provided a first distance from the center of receiving aperture 161, the second distance being less than the first distance. In addition, table 120 has been placed on outer side or first side 262 of side plate 160. In FIG. 14, table 120 has had the numbers corresponding with each aperture 181 (as shown in FIGS. 5 and 6) replaced by letters. Table 120 assists a user or shooter in selecting the desired target position and corresponding aperture 181 based upon a desired simulated elevation of the target in feet (x-axis) and a desired distance the user or shooter is away from the target in yards (y-axis). It should be appreciated that these features provided on side plate 160 may be identically and/or correspondingly provided on side plate 162.

Figure 15:
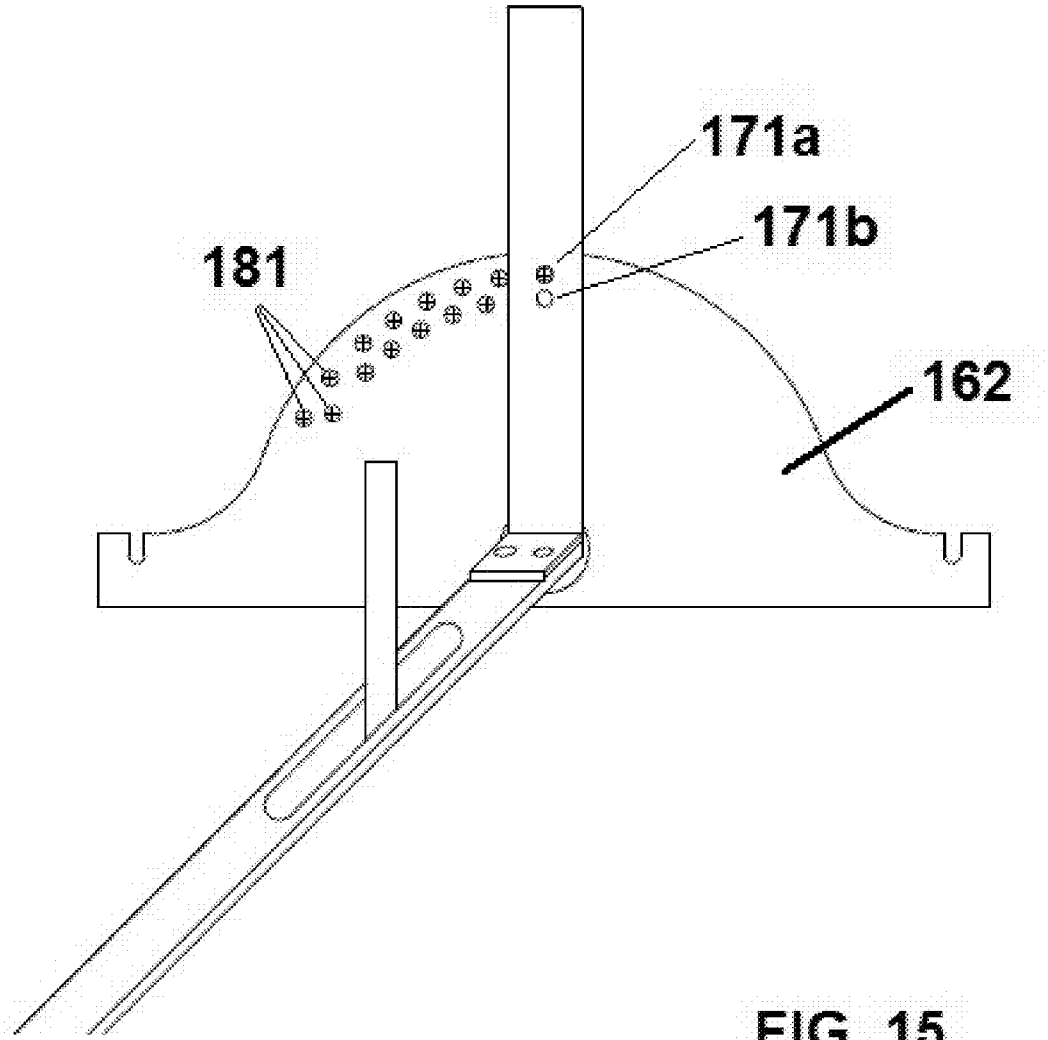
FIG. 15 is a zoomed in view of a portion of the adjustable target stand of FIG. 12, taken along line 15-15 of FIG. 12.

Referring to FIG. 15, handle 174 may include a plurality of handle apertures 171*a*, 171*b*. First handle aperture 171*a* may be provided through handle 174 in order to align with the apertures 181 provided in the first row. Similarly, second handle aperture 171*b* may be provided through handle 174 in order to align with the apertures 181 provided in the second row. As discussed above, pins 182*a*, 182*b* are adapted to be received through respective handle apertures 171*a*, 171*b* provided in handles 172, 174. Pin 182*a* is adapted to be received by a desired, targets aperture 181 and then the associated handle apertures 171*a*, 171*b* provided in handle 172. Similarly, pin 182*b* is adapted to be received by a desired, targets aperture 181 and then the associated handle apertures 171*a*, 171*b* provided in handle 174. It should be appreciated that these features provided on side plate 162 and handle 174 may be identically and/or correspondingly provided on side plate 160 and handle 172.

It should be appreciated in various embodiments that while angle retention member 182 is illustrated as a pin, any suitable or desired system or equipment which may act as an angle retention member 182 may be used. This may include, for example, but not limited to, a selectively depressible button which is provided on handle 172, 174 and which may engage one of apertures 181 of target angle assembly 180.

In operation and use of one or more examples of embodiments of the target stand 100, 200, a user may initially mount, attach, or couple a target 800 to the target stand 100, 200 using target supports 155*a*, 155*b*. For example, a user may mount target 800 over the first and second target supports 155*a*, 155*b*. In addition, a user may place the target stand 100, 200 and associated target 800 in a desired location to shoot at the target 800.

Once the target 800 is mounted to the target stand 100, 200 and the target stand 100, 200 is placed in a desired location for shooting, a user or shooter will determine the target orientation they wish to simulate. The user or shooter will establish a desired elevation height, or distance the user or shooter will be above the target, in feet. The user will also establish a desired target distance, or distance the user or shooter will be away from the target, in yards. Based upon the two hypothetical or desired criteria, the user will utilize the associated table 120 illustrated above to identify the associated target position number or letter associated with an specific aperture 181 provided in plates 160 and/or 162. For example, if a user desires to simulate the target orientation where the user is twenty-two (22) feet above the target and twenty (20) yards away from the target, the corresponding target position number from the table above is "five" (5) or the letter "E" depending upon the table 120 used. The user will then adjust the target orientation selector assembly 170. It should be appreciated that table 120 may be provided on target stand 100, 200, such as a sticker or laser etching provided on one or both plates 160, 162. In addition, or the alternative, table 120 may be provided as an enclosed card or on a separate document for use by the user or shooter.

To adjust the target orientation selector assembly 170, the user or shooter will remove one or more pins 182 associated with the target orientation selector assembly 170 of each side plate 160, 162. The user or shooter will then apply rotational force through one or more handle(s) 172, 174 to rotate cross member 152 until the handle aperture(s) 171 overlap the desired aperture(s) 181 provided in side plate(s) 160, 162. Once the handle aperture(s) 171 overlaps the desired side plate aperture(s) 181, the user or shooter will engage the pin(s) 182, such that the pin 182 is received by and engages with the handle aperture(s) 171 and the desired side plate aperture(s) 181 for side plate(s) 160, 162. Once pins 182 engage the handles 172, 174 to the desired aperture 181 of the respective target angle assembly 180 of the target orientation selector assembly 170 provided on the respective side plate(s) 160, 162 with pin(s) 182, the user, shooter, or a third party shooter may shoot at the target 800.

Although various representative embodiments of this invention have been described above with a certain degree of particularity, those skilled in the art could make numerous alterations to the disclosed embodiments without departing from the spirit or scope of the inventive subject matter set forth in the specification and claims. Joinder references (e.g., attached, coupled, connected) are to be construed broadly and may include intermediate members between a connection of elements and relative movement between elements. As such, joinder references do not necessarily infer that two elements are directly connected and in fixed relation to each other. In some instances, in methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although various representative examples of embodiments of this invention have been described above with a certain degree of particularity, those skilled in the art could make numerous alterations to the disclosed embodiments without departing from the spirit or scope of the inventive subject matter set forth in the specification and claims. In some instances, in methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to particular embodiments, persons skilled in the art will recognize that changes may be made in form and detail without departing from the spirit and scope of the invention.

What is claimed is:

1. An adjustable target stand comprising:

a support assembly including a cross member pivotably received by opposing first and second side plates, at least one target support member carried by and projecting from the cross member; and a target orientation assembly including a handle coupled to the pivotable cross member, the handle having a handle aperture, and a plurality of apertures provided through the first side plate and radially extending a first distance from a first cross member receiving aperture provided in the first side plate, the plurality of apertures each in alignment with the handle aperture such that the handle is pivotable between the plurality of apertures such that an angle retention member may engage the handle aperture with one of the plurality of apertures.

2. The adjustable target stand of claim 1, wherein each of the plurality of apertures provided through the first side plate corresponds to a pivoted position of a target coupled to the at least one target support member.

3. The adjustable target stand of claim 1, wherein each of the plurality of apertures includes an individual identifier for selecting a desired aperture and associated pivoted position of a target coupled to the at least one target support member.

4. The adjustable target stand of claim 1, further comprising at least one support leg coupled to each of the first and second side plates.

5. The adjustable target stand of claim 4, wherein two support legs are coupled to the first side plate and extend in a first plane, and two support legs are coupled to the second side plate and extend in a second plane parallel to the first plane.

6. The adjustable target stand of claim 4, wherein two support legs are coupled to the first side plate and are received into the ground which the target stand rests upon, and two support legs are coupled to the second side plate and are received into the ground which the target stand rests upon.

7. The adjustable target stand of claim 1, wherein the handle aperture is a first handle aperture, a second handle aperture is provided in the handle, the plurality of apertures provided through the first side plate include a first plurality of apertures which radially extend a first distance from the first cross member receiving aperture provided in the first side plate, and a second plurality of apertures which radially extend a second distance from the first cross member receiving aperture provided in the first side plate, wherein the first handle aperture is provided in alignment with the first plurality of apertures and the second handle aperture is provided in alignment with the second plurality of apertures.

8. The adjustable target stand of claim 1, wherein the at least one target support member includes a first target support member coupled to the cross member though a first target support receiving aperture provided in the cross member, and a second target support member coupled to the cross member though a second target support receiving aperture provided in the cross member.

9. The adjustable target stand of claim 8, wherein the first target support receiving aperture has a length greater than its width to allow for the selective retention of the first target support member along the first target support receiving aperture.

10. The adjustable target stand of claim 9, wherein the second target support receiving aperture has a length greater than its width to allow for the selective retention of the second target support member along the second target support receiving aperture.

11. The adjustable target stand of claim 1, wherein the angle retention member is a pin.

12. The adjustable target stand of claim 1, wherein the angle retention member is a detent pin.

13. An pivotable target stand comprising:

a cross member having a first end and a second end, the first end pivotably received by a first receiving aperture provided in a first side plate, the second end pivotably received by a second receiving aperture provided in a second side plate, and a target support member carried by and projecting from the cross member; and a handle coupled to the cross member and adapted to pivot the cross member about an axis formed between the first and second receiving apertures of the first and second side plates, the handle having a handle aperture which corresponds to a plurality of apertures provided in the first side plate, the plurality of apertures radially provided along the first side plate, the handle aperture provided in alignment with the plurality of apertures such that an angle retention member is received by the handle aperture and one of the selected plurality of apertures provided in the first side plate.

14. The pivotable target stand of claim 13, wherein a plurality of target support members are carried by and projecting from the cross member.

15. The pivotable target stand of claim 13, wherein the first side plate has a first side away from the cross member and a second side facing the cross member, the handle is provided on the first side of the first side plate.

16. The pivotable target stand of claim 13, wherein the first side plate has a first side away from the cross member and a second side facing the cross member, the handle is provided on the second side of the first side plate.

17. The pivotable target stand of claim 13, wherein each of the plurality of apertures provided in the first side plate extend a first distance from the first receiving aperture provided in a first side plate.

18. The pivotable target stand of claim 13, wherein the plurality of apertures provided in the first side plate includes a first plurality of apertures which are radially provided along the first side plate, each of which extend a first distance from the first receiving aperture provided in a first side plate, and a second plurality of apertures which are radially provided along the first side plate, each of which extend a second distance from the first receiving aperture provided in a first side plate, the first distance being greater than the second distance.

19. The pivotable target stand of claim 18, wherein the handle aperture is a first handle aperture which corresponds to the first plurality of apertures provided in the first side plate, and a second handle aperture is provided in the handle and which corresponds to the second plurality of apertures provided in the first side plate, such that the first handle aperture is provided in alignment with the first plurality of apertures to receive an angle retention member, and the second handle aperture is provided in alignment with the second plurality of apertures to receive an angle retention member.

20. The pivotable target stand of claim 13, wherein each of the apertures corresponds to an angle by which a target coupled to the stand is positioned.

* * * * *